United States Patent [19]

Fasano

[11] Patent Number: 4,685,506

[45] Date of Patent: Aug. 11, 1987

[54] BILLET LAUNCHING DEVICE IN CONTINUOUS CASTING MACHINES

[75] Inventor: Fulvio Fasano, Gorizia, Italy

[73] Assignee: Danieli & C. Officine Meccaniche S.p.A., Buttrio, Italy

[21] Appl. No.: 807,218

[22] Filed: Dec. 12, 1985

Related U.S. Application Data

[63] Continuation of Ser. No. 610,185, May 15, 1984, abandoned, which is a continuation of Ser. No. 335,515, Dec. 29, 1981, abandoned.

[30] Foreign Application Priority Data

Jan. 27, 1981 [IT] Italy ..... 83318 A/81

[51] Int. Cl.[4] ..... B22D 11/08

[52] U.S. Cl. ..... 164/416; 164/442; 164/446

[58] Field of Search ..... 164/441, 442, 425, 426, 164/445, 446, 478, 483, 484, 416

[56] References Cited

U.S. PATENT DOCUMENTS

| | | | |
|---|---|---|---|
| 2,079,644 | 5/1937 | Williams | 164/425 X |
| 2,912,100 | 11/1959 | Logan | 226/157 X |
| 3,344,844 | 10/1967 | Reinfeld et al. | 164/426 |
| 3,433,287 | 3/1969 | Greenberger | 164/426 |
| 3,800,849 | 4/1974 | Knell et al. | 164/425 X |
| 3,882,924 | 5/1975 | Fujikawa | 164/441 X |
| 4,214,623 | 7/1980 | Jaenson | 164/478 |

FOREIGN PATENT DOCUMENTS

| | | | |
|---|---|---|---|
| 754771 | 1/1971 | Belgium | 164/442 |
| 195046 | 1/1958 | Fed. Rep. of Germany | 164/445 |
| 54-4820 | 1/1979 | Japan | 164/425 |
| 760154 | 10/1956 | United Kingdom . | |
| 840676 | 6/1960 | United Kingdom | 164/426 |
| 842358 | 7/1960 | United Kingdom . | |
| 1054332 | 1/1967 | United Kingdom . | |
| 1108167 | 4/1968 | United Kingdom . | |
| 1354139 | 5/1974 | United Kingdom . | |
| 582045 | 11/1977 | U.S.S.R. | 164/442 |
| 715210 | 2/1980 | U.S.S.R. | 164/442 |
| 759216 | 8/1980 | U.S.S.R. | 164/442 |

*Primary Examiner*—Kuang Y. Lin

*Attorney, Agent, or Firm*—Stevens, Davis, Miller & Mosher

[57] ABSTRACT

This invention concerns a billet launching device in continuous casting machines of the type employed to withdraw and pull the billet from the ingot mould along the casting line, whereby the device comprises, near the outlet of the ingot mould, gripping means cooperating at least momentarily with a launching element able to engage and pull the billet at least momentarily, and whereby the launching element is inserted momentarily into the ingot mould and engages the billet.

5 Claims, 4 Drawing Figures

BILLET LAUNCHING DEVICE IN CONTINUOUS CASTING MACHINES

This application is a continuation of application Ser. No. 610,185 filed May 15, 1984, which in turn is a continuation of application Ser. No. 335,515 filed Dec. 29, 1981, both now abandoned.

This invention relates to a billet launching device in continuous casting machines.

To be more exact, the invention relates to a device able to withdraw a billet from an ingot mould and to take it as far as the pulling group which completes the withdrawal and discharge of the billet.

It is known that the means and systems employed to withdraw and pull the billets are bulky and complex.

Thus, some of the withdrawal devices require the use of dummy bars the length of which is not less than the distance, amounting to various meters, between the outlet of the ingot mould and the pulling group.

Other withdrawal means are suitably powered and are therefore complicated and expensive.

The dummy bars, therefore, need complex means to be stored and re-positioned and also require considerable space for being handled owing to their length, which is not negligible.

There is also the drawback that, in order to insert and locate the dummy bars in the withdrawal path so that a new production cycle can begin, it is necessary to wait for the withdrawal path to be wholly free, and this leads to the creation of long down times.

Some improvements have been applied to such dummy bars and have enabled their length to be reduced, but only partially. The problems involved in storing and re-positioning them, therefore, have not been fully overcome.

According to this invention a launching element of negligible dimensions is employed to withdraw the billets.

The launching element does not need the complex storage and re-insertion means used in the known art, for the element is inserted advantageously from above through the ingot mould itself.

In this way the times needed to ready the machine for each withdrawal cycle are lessened appreciably.

Furthermore, the device proposed by this invention enables the overall bulk of the machine itself to be reduced considerably.

Yet another advantage of this invention lies in the fact that the withdrawal group acts on the billet with only one direction of forward movement.

Under this invention the billet is first withdrawn from the ingot mould owing to the effect of the alternating motion imparted to the mould by the normal means applying oscillation to the ingot mould and, in coordination therewith, owing to the action performed on the billet by gripping means.

In effect, according to the invention the gripping means enable the launching element and the billet to proceed along the casting line, and hinder any movements thereof in the opposite direction.

This invention, therefore, is embodied in a billet launching device in continuous casting machines of the type employed to withdraw and pull the billet from the ingot mould along the casting line. The device is characterised by comprising, near the outlet of the ingot mould, gripping means which cooperate at least momentarily with a launching element able to butt upon the billet, the launching element being inserted advantageously into the ingot mould.

Other details and features of the invention will stand out from the description given below by way of non-limitative example and with reference to the accompanying drawings, in which.

With reference to the figures, the same parts or parts performing the same funcitons bear the same reference numbers.

Figure 1:
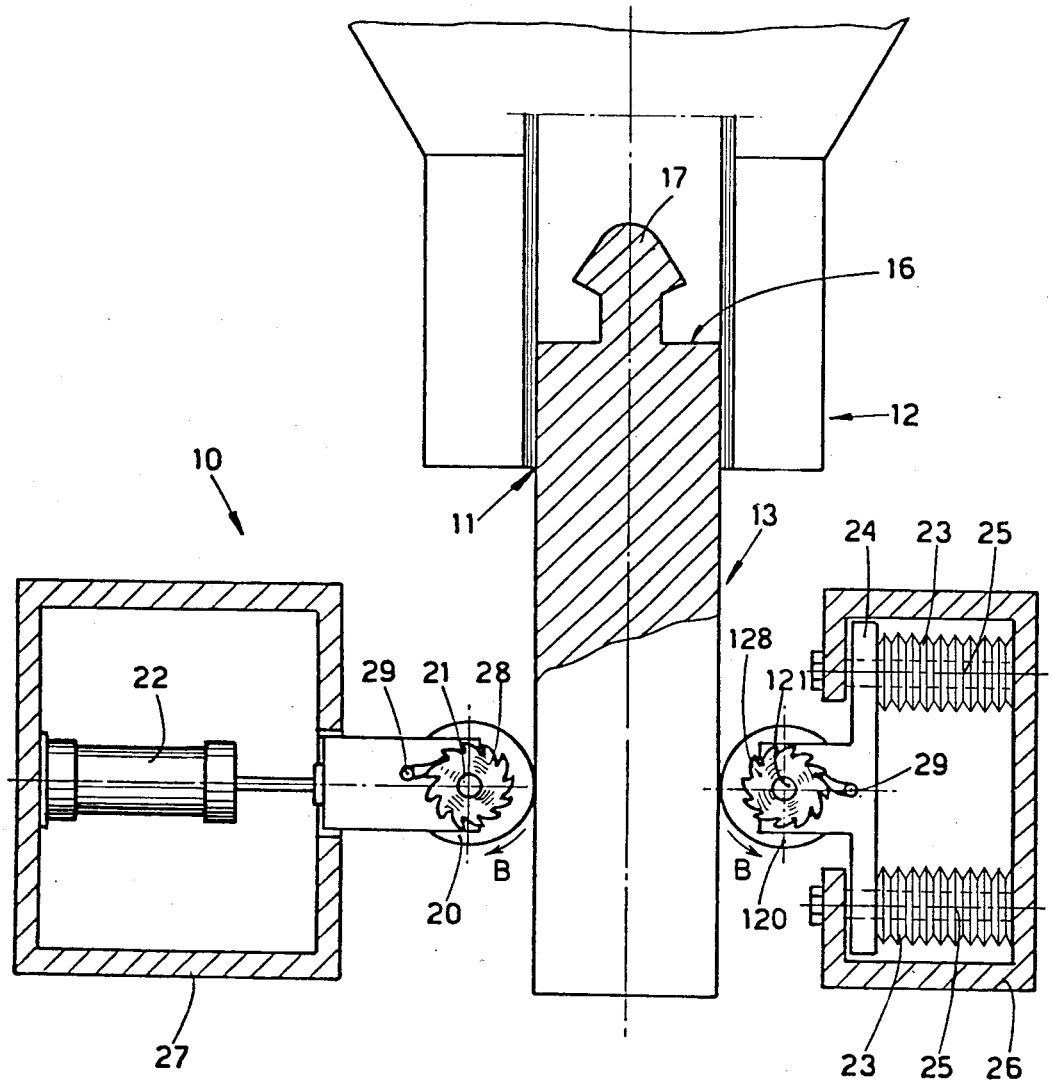
FIG. 1 shows diagrammatically the gripping means as seen from the side.

FIG. 1 shows the gripping means 10 located in this instance close to the outlet 11 of the ingot mould 12.

Figure 2:
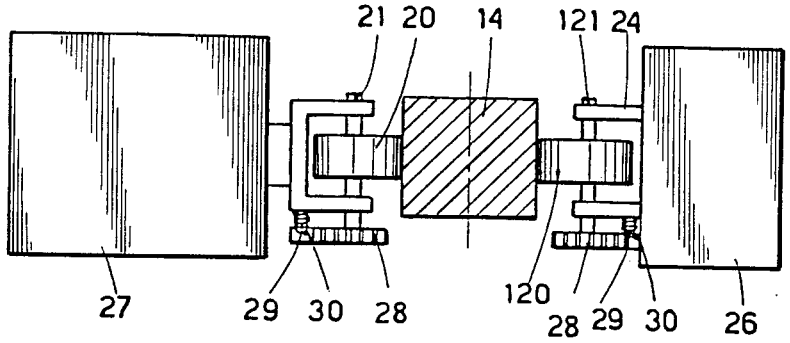
FIG. 2 shows diagrammatically the gripping means of FIG. 1 as seen from above.
Figure 3:
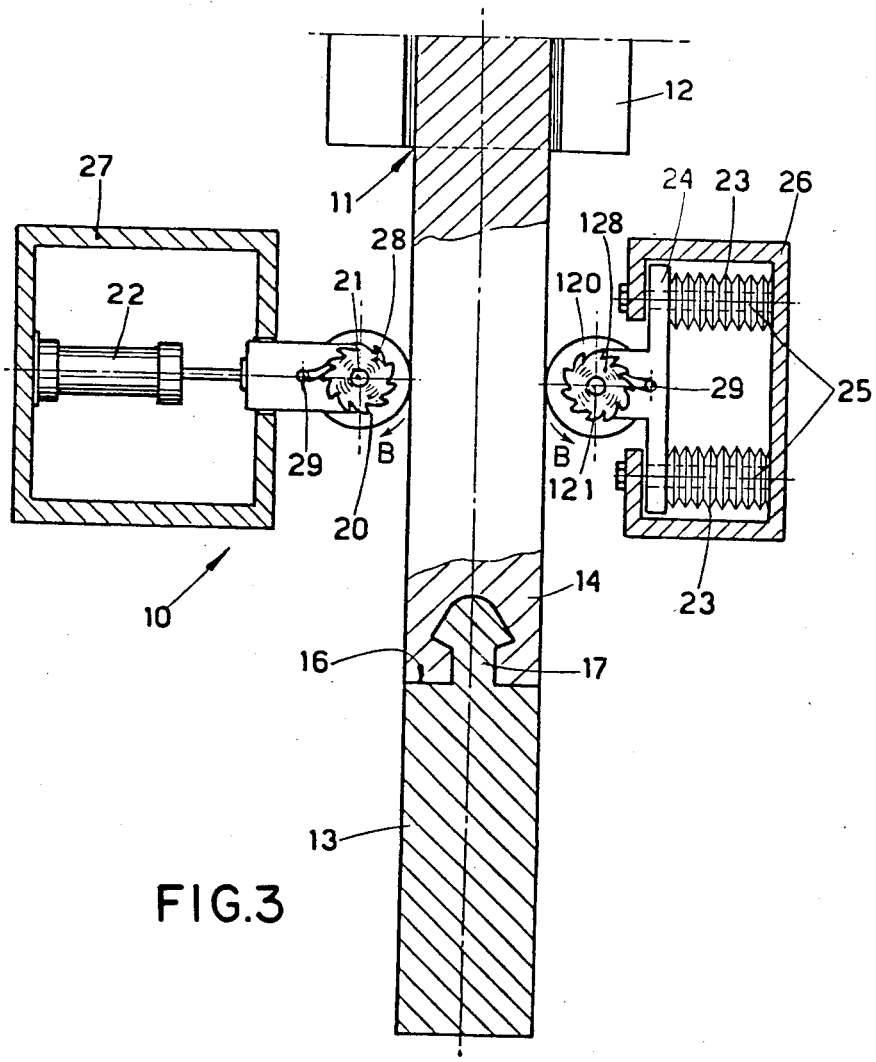
FIG. 3 shows diagrammatically a phase of the withdrawal of the billet.

The gripping means 10 cooperate with a launching element 13 at the start of withdrawal, as shown in FIGS. 1 & 2, and act on the billet 14 during the phase of its withdrawal from the ingot mould 12, as can be seen in FIG. 3, until the billet 14 has almost reached the withdrawal or pulling group 15.

The launching element 13 consists here of a stub of bar long enough to connect the end tract of the outlet 11 of the ingot mould 12 to the gripping means 10 and comprises at least one zone having a section substantially like or the same as that of the billet 14 being formed.

The launching element 13 is put into the outlet conduit 11 of the ingot mould 12 from above and in this way can also act as an outlet plug for the ingot mould 12.

Moreover, the launching element 13 comprises on its upper face 16 a connecting element 17 of a known type, which enhances the connection between the launching element 13 and the billet 14 to be withdrawn.

The connecting element 17 can have any desired helpful shape.

It is also possible that a hollow is machined in the launching element 13 and communicates with the outside through the upper face 16, or else that the face 16 comprises a particular roughness or protruding elements or other like means, whereby the variations are able to pursue the same purpose as the connecting element 17.

Withdrawal of the billet 14 is brought about by making the ingot mould 12 oscillate vertically along the line or direction of casting.

Figure 4:
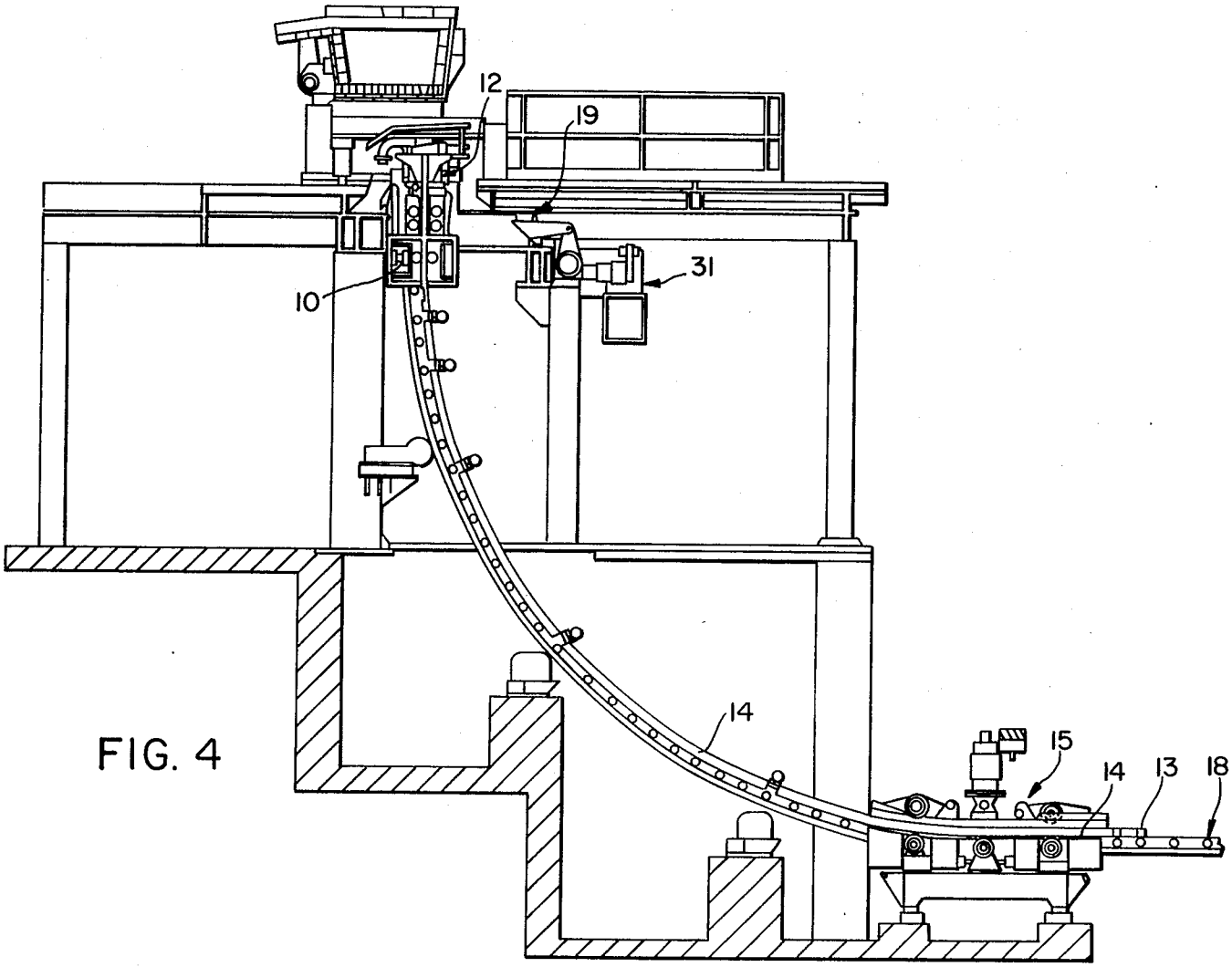
FIG. 4 shows diagrammatically the machine employed for withdrawing and conveying the billets.

The oscillation is imparted to the ingot mould 12 by suitable oscillator means 31 of a generally known type through appropriate mechanical transmission organs 19 of a known kind, as shown diagrammatically in FIG. 4.

Such oscillation facilitates the release of the outer skin of the billet 14 being formed, from the inner walls of the outlet conduit 11 and enables the billet 14, which butts upon the launching element 13, to be pushed downwards.

During the withdrawal phase the billet 14 is made to pass between opposed pressing rollers 20, 120, which consist here of rollers able to revolve in only one direction, which is indicated with the letter B in FIGS. 1 & 3.

This is obtained in this instance by keying onto the axles of rotation 21, 121 of the means 20, 120 and fixing solidly thereto 21, 121 a toothed wheel 28, 128 with saw-like teeth sloping in the opposite direction to the direction B. In this way the toothed wheel 28, 128 and therefore its relative axle 21, 121 are hindered from revolving in the opposite direction owing to the action of a ratchet 29, 129 which is elastically (30) pushed against the toothed wheel 28, 128.

The ratchet 29, 129 and toothed wheel 28, 128 constitute substantially a free wheel 28, 29 which enables the means 20, 120 to revolve freely in the direction B.

During oscillation of the ingot mould 12 such a layout enables the billet 14 to be made to go downwards and to be held in the position momentarily reached during the phase of ascent of the ingot mould 12.

In this way the withdrawal of the billet 14 takes place with a step-by-step movement, one step being taken in each period of oscillation or of alternating up-and-down motion of the ingot mould 12.

Furthermore, the pressing means 20, 120 comprise a friction surface which is advantageously rough with a pre-set degree of roughness, the purpose being to obtain a better grip by the pressing means 20, 120 on the billet 14 or launching element 13.

It also is possible that the surface is smooth and suitably grooved.

The thrust against the billet 14 is imparted to the pressing means 20, 120 respectively by a jack 22 and by thrust spring means 23.

In particular, the jack 22 acts on the axle of rotation 21 of the means 20, whereas the thrust spring means 23 act on a movable structure 24 which bears the axle of rotation 121 of the pressing roller 120 and which can slide on suitable guides 25.

Besides the guides 25, the thrust spring means 23 are secured to a carrying structure 26 separate from the structure 27 which bears the jack 22.

The two structures 26, 27 can also act as protective frames for the gripping means 10, are rigidly or elastically connected.

The billet 14, which is withdrawn and made to proceed along the casting line 18 through the gripping means 10, is seized, after a given length of its path, and fully withdrawn by the pulling group 15.

The release of the billet 14 by the gripping means 10 follows the action of the pulling group 15 and is obtained by making the stem of the jack 22 retract automatically or by manual control.

When the withdrawal of the billet 14 has been completed, it is possible to arrange for recovery of the launching element 13 or of a part thereof.

A preferential embodiment of this invention has been described, but variations are possible. Thus the shapes and sizes can be varied and it is possible to use thrust springs 23 in a number different from that shown and in different positions. It is also possible to contemplate the use of thrust springs 23 of a different type, namely leaf springs or other springs.

The use of one or more jacks 22 of a hydraulic of pneumatic type positioned differently can be utilized.

It is also possible to use thrust elements consisting only of jacks 22 or only of thrust springs 23 and in both such cases the jacks 22 and the thrust springs 23 may cooperate with lever means so as to act on both the pressing means 20, 120 at the same time.

It is also possible that some jacks 22 and some thrust springs 23 can cooperate together with each pressing means 20, 120.

It is possible that the pressing means 20, 120 are secured directly to the carrying structures 26, 27 and that pressing means 20 are employed in a number other than two and in different positions.

It is possible to arrange for the launching element 13 to consist of a plurality of elements connected together by welding or with removable connectors.

It is possible that instead of the pressing means 20, 120 a plurality of opposed sliding blocks can be used which are pressed elastically or rigidly against the billet 14, which is made to pass between them.

The sliding blocks can have a surface with a preferential direction of sliding, the surface being treated chemically and/or mechanically and/or being sloped in relation to the surface of the billet 14.

It is possible also that the sliding blocks comprise, in at least one part of their zone of contact with the billet 14, some teeth which are at least partially augmented in the direction of forward movement of the billet 14.

Owing to the surface treatment and/or to the special slope and/or to the presence of the teeth, the sliding blocks resist any sliding of the opposed surface in a direction opposite to the preferential direction.

It is possible also that the pressing means 20 comprise entraining motor means having a speed of their axle of rotation which can be regulated advantageously.

These and other variations are all possible for a technician in this field without departing thereby from the scope of the invention.

What is claimed is:

1. Billet launching device for use in a continuous casting machine of the type employed for moving the billet from an ingot mold oscillating along the casting line, comprising gripping means driven only by movement of a launching element and attached billet along the casting line in a direction away from said ingot mold and passively freely rotatable only in a direction away from said ingot mold about an axis, said axis being stationary with respect to movement along the casting line, said gripping means being placeable near the outlet of the ingot mold to maintain continuous contact and to grip said launching element and attached billet as they move between said means, said gripping means cooperating with said launching element and billet to permit movement of the billet in one longitudinal direction only.

2. The billet launching device as in claim 1, wherein said gripping means comprise pressing means which allow only forward movement of the billet.

3. The billet launching device as in claim 2, wherein said pressing means are wheel means or roller means cooperating with a toothed wheel and rachet.

4. The billet launching device as in claim 2, wherein said pressing means comprise opposed thrust means spaced to receive therebetween an emerging billet, one of said thrust means includes a jack whereby said thrust means can be momentarily released.

5. The billet launching device as in one of claims 2, 3, and 4, including oscillation means, said pressing means cooperating with said oscillation means to move said billet out of said mould.

* * * * *